US010011961B2

(12) United States Patent
Bouleau et al.

(10) Patent No.: US 10,011,961 B2
(45) Date of Patent: Jul. 3, 2018

(54) MOBILE CROSSING STRUCTURE

(71) Applicant: INGENI SA, Carouge (CH)

(72) Inventors: Etienne Bouleau, Morges (CH); Gabriele Guscetti, Carouge (CH)

(73) Assignee: INGENI SA (CH)

( * ) Notice: Subject to any disclaimer, the term of this patent is extended or adjusted under 35 U.S.C. 154(b) by 57 days.

(21) Appl. No.: 15/039,856

(22) PCT Filed: Sep. 29, 2014

(86) PCT No.: PCT/IB2014/001944
§ 371 (c)(1),
(2) Date: May 27, 2016

(87) PCT Pub. No.: WO2015/079293
PCT Pub. Date: Jun. 4, 2015

(65) Prior Publication Data

US 2016/0376754 A1 Dec. 29, 2016

(30) Foreign Application Priority Data

Nov. 28, 2013 (CH) ..... 1977/13

(51) Int. Cl.
*E01D 15/24* (2006.01)
*E01D 6/00* (2006.01)
(Continued)

(52) U.S. Cl.
CPC ..... *E01D 15/24* (2013.01); *E01D 6/00* (2013.01); *E01D 15/02* (2013.01); *E01D 15/12* (2013.01); *E01D 19/04* (2013.01)

(58) Field of Classification Search
CPC ..... E01D 15/124; E01D 15/133; E01D 6/00; E01D 21/00; E01D 15/24; E01D 15/02; E01D 15/12; E01D 19/04; E01D 19/12
See application file for complete search history.

(56) References Cited

U.S. PATENT DOCUMENTS 175,150 A * 3/1876 Pfautz ..... E01D 15/124 14/45
2,030,262 A * 2/1936 Maddock ..... B23Q 11/0003 14/73.1

(Continued)

FOREIGN PATENT DOCUMENTS

| | | |
|---|---|---|
| FR | 2804981 | 8/2001 |
| GB | 534913 | 3/1941 |
| JP | 2007107369 | 4/2007 |

*Primary Examiner* — Abigail A Risic
(74) *Attorney, Agent, or Firm* — Galbreath Law Offices, P.C.; John A. Galbreath

(57) ABSTRACT

A movable and dynamic work after construction linking two points separated by a natural or man-made obstacle, allows the permanent crossing of this obstacle. The work includes a deformable apron (1) which extends between said two points. The work comprises a set of elongated elements (2, 3). An assembly of several pairs of elements (2, 3) is disposed along the apron (1). The work comprises drive means (8) disposed at one end or at both ends of said work for adjusting the apron (1) lengthwise. The drive means (8) are arranged so that, when the means (8) are actuated, they drive the assembly of the pairs of elements (2, 3), so as to bulge the central portion of the apron (1) when the means (8) are actuated.

9 Claims, 4 Drawing Sheets

(51) Int. Cl.

| | |
|---|---|
| ***E01D 15/02*** | (2006.01) |
| ***E01D 19/04*** | (2006.01) |
| ***E01D 15/12*** | (2006.01) |

(56) References Cited

U.S. PATENT DOCUMENTS

| | | | | |
|---|---|---|---|---|
| 2,697,845 | A * | 12/1954 | Broner | E01D 15/124 14/45 |
| 2008/0184502 | A1* | 8/2008 | Roberts | A61G 3/061 14/71.1 |
| 2008/0263791 | A1* | 10/2008 | Roberts | B60P 1/435 14/71.1 |
| 2012/0074035 | A1 | 3/2012 | Deschamps | |

* cited by examiner

MOBILE CROSSING STRUCTURE

The present invention relates to a movable crossing work of progressively changing shape by a mechanical actuation.

In a general manner, a work is a construction required for the establishment and the exploitation of a communication channel such as a bridge, a tunnel or a wall. In the case of a bridge, the structure allows crossing a depression or an obstacle (watercourses, communication channel, valley, etc.) by passing over this separation. The complexity increases when the passage of men and the passage of water crafts must coexist even though the freeboard of the work does not allow the combined passage of men and water crafts.

There are several achievements allowing the passage of men or vehicles intermittently with the passage of water crafts. The main drawback of these achievements is that the crossing of the bridge by men or the vehicles must be interrupted while the water crafts have crossed the work.

Another alternative is to use temporary works, in other words a bridge which would be deployed for the passage of persons or vehicles and which might wind for the passage of the water crafts.

US20120074035 describes a temporary bridge comprising two spans, each comprising bridge elements intended to be superposed when said bridge is in a first position called non-deployed position. The bridge elements of each of said spans are articulated relative to each other. The bridge includes displacement means of each of said bridge elements superposed on another bridge element in said first position, between this first position and a second position, called deployed position, where said bridge elements are coupled to form said bridge. The drawback of this system is that it does not permit the simultaneous passage of men or vehicles and water crafts.

FR2804981 describes a windable, modular, articulated beam of variable geometric shape and length which is composed of articulated modules, each of them having a rigid portion and a flexible portion including a resistant element such as for example a cable or a chain, the modules are joined for the use of the beam, on the one hand, at the rigid portions, by articulations, on the other hand, at the flexible portions, by elements such as, in particular, flanges or pins and lugs. This beam is used, in particular, for formworks in which the use of vertical traditional piers is not suitable, such as for example, in the construction of bridges in the works where it is not desired to interrupt either the passage of people or goods.

JP2007107369A describes a structure serves as a bridge, the structure being formed on both sides of lateral elements in the form of bars, which may be assembled at their center and their ends by a pin. This structure is fixed once mounted. It is stretchable and bendable during the installation and, once the structure is put in place, fastening elements allow locking the final position of the structure so as to immobilize the stretching of the structure. The fastening elements are disposed at least at one end of the structure and, once the desired shape is obtained, they allow holding the structure in position. Unlike the present invention, the structure is no longer stretchable and retractable when the fastening elements are placed on either side of the structure.

The purpose of the present invention is therefore to provide a deformable, movable and dynamic work after its installation, allowing increasing the freeboard to let the water crafts (or other) pass without interrupting the crossing of pedestrians and/or vehicles.

The concept of accessibility integrates several components such as the access (transport, parking, sidewalks, threshold, . . . ), the circulation within a building, or the use of all the equipments (toilets, canteen, . . . ). Furthermore, assuming that everyone should be able to move and circulate without risk, in particular the most vulnerable people, the present invention provides comfort as to disabled people, as to drivers of motorized vehicles or even drivers of water crafts.

According to the invention, a movable and dynamic work after construction, in particular a bridge, linking two points separate by an obstacle, the work allowing the permanent crossing of this obstacle. The work includes a deformable apron which extends between said two points and a set of elongated elements having three openings, a first opening at each end of the elements and a second intermediate opening disposed between the first two openings present at the ends of the elements. The openings receive ball joints used for forming hinges, each element consisting of a first short portion between a first opening and the intermediate opening and of a second longer portion between the other first opening and the intermediate opening. Pairs of elements are movable by rotation, around a central hinge constituted by a ball joint in the intermediate openings of the two elements. An assembly of pairs of elements is made by ball joints inserted into the openings disposed at the ends of each element, the assembly of said elements being disposed along the apron on one side or both sides of the apron in a plane substantially perpendicular to the axis of said hinges and allowing a movement relative to each other from a first position to a second position taking place in said plane perpendicular to the axis of the hinge. Said short portions of the elements are disposed on the upper portion of the pairs of elements disposed at the ends of the work while said short portions of the elements are disposed on the lower portion of the pairs of elements disposed towards the center of the work. Drive means are disposed at one or both ends of said work for adjusting the apron lengthwise. The drive means are arranged so that when the means are actuated, they drive the assembly of pairs of elements, so as to bulge the central portion of the apron when both ends of the work are drawn lengthwise, the drive means which may be actuated after construction of the work so as to make it movable and dynamic.

The features of the invention will appear more clearly on reading several embodiments given purely by way of non-limiting example, with reference to the schematic figures, in which.

In one embodiment, a gangway links two points separate by a watercourse. The gangway comprises a deformable apron 1 which extends between said two points.

Figure 1:
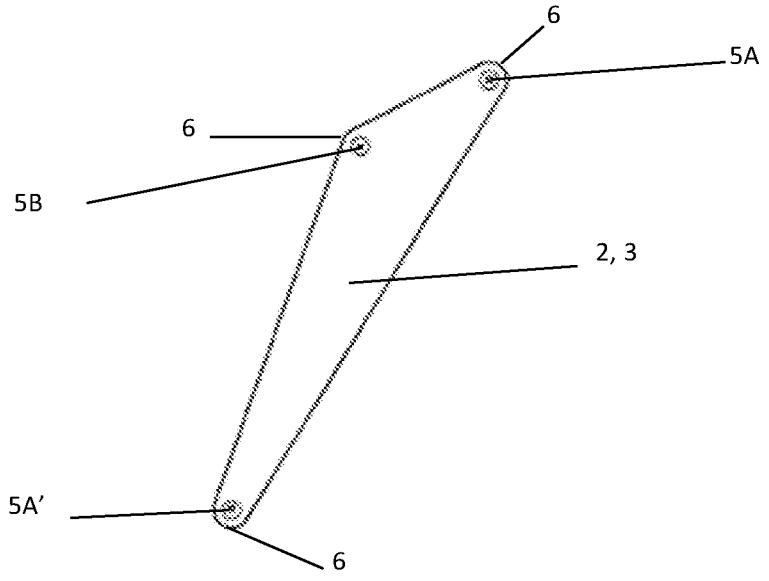
FIG. 1 shows a side view of a triangular elongated element for the implementation of the invention.

As illustrated in FIG. 1, the gangway comprises a set of substantially triangular (scalene triangle) elongated elements 2, 3 having three openings 5A, 5A', 5B at the tops 6 for receiving ball joints. A first opening 5A, 5A' is disposed at each end/top of the elements 2, 3 and a second intermediate opening 5B is disposed between the two first openings 5A, 5A, the intermediate opening 5B being represented by the top having the largest angle. In the illustrated example, the largest angle is about 140° but may vary from 120° to 160° or even from 91° to 179°. The elements 2, 3 are flat and their thickness will depend on the used material. The ball joints are used to form hinges 4.

Each element 2, 3 consists of a first short portion between a first opening 5A and the intermediate opening 5B and of a second longer portion between the other first opening 5A' and the intermediate opening 5B.

Figure 2:
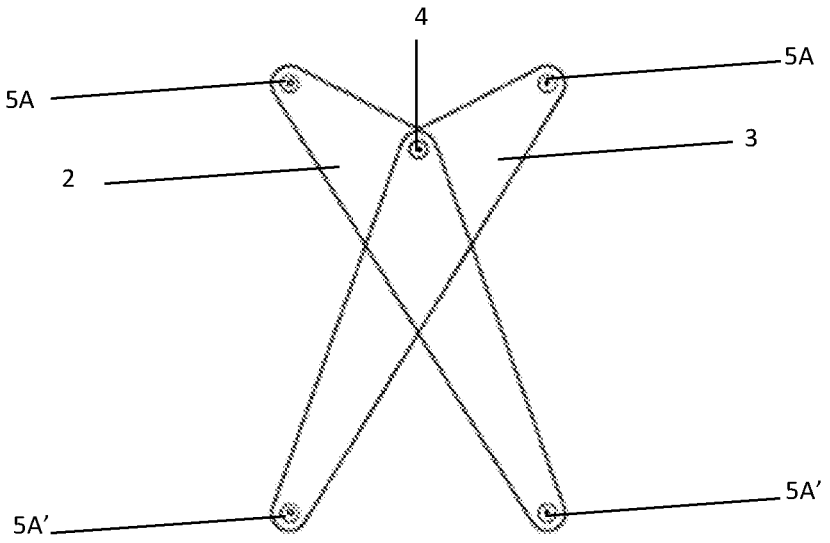
FIG. 2 shows a side view of a pair of triangular elongated elements for the implementation of the invention.

As illustrated in FIG. 2, pairs of elements 2, 3 are movable by rotation, around a central hinge 4 consisting of a ball joint in the intermediate openings 5B of the two elements 2, 3.

Figure 3:
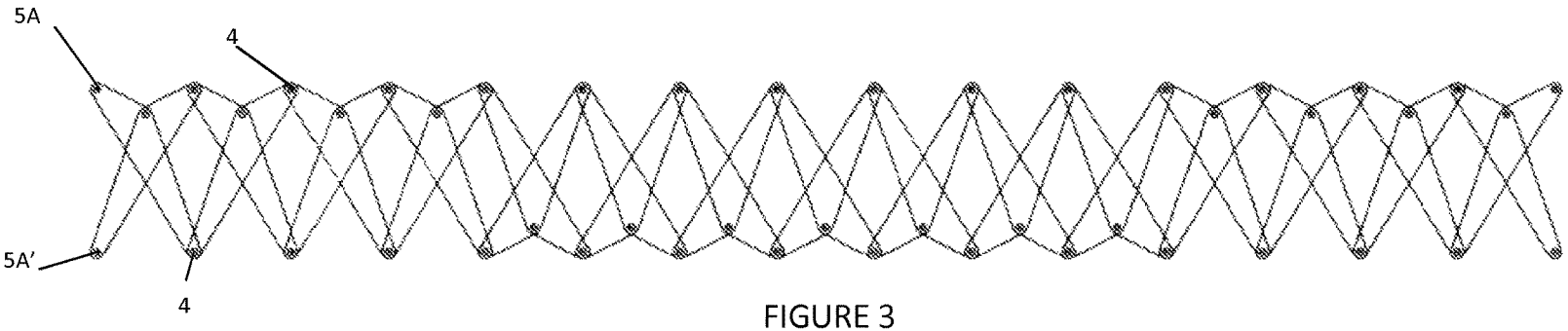
FIG. 3 shows a side view of an assembly of pairs of triangular elongated elements for the implementation of the invention.
Figure 4:
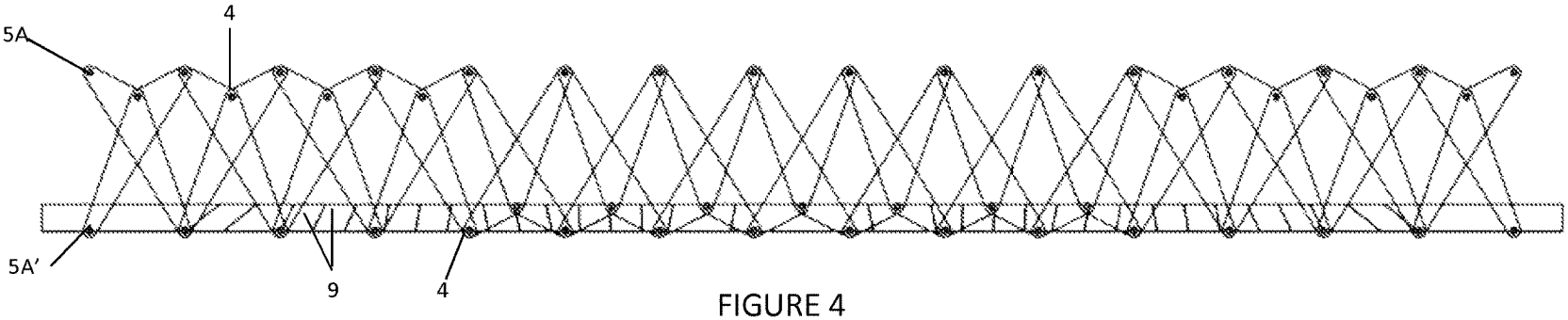
FIG. 4 shows a side view of a work including an assembly of pairs of triangular elongated elements and a deformable apron in the flat position.

FIG. 3 illustrates an assembly of pairs of elements 2, 3 being made by ball joints inserted into the openings 5A, 5A' disposed at the ends of each element 2, 3. As illustrated in FIG. 4, the assembly of elements 2, 3 is disposed along the apron 1, on a side of the apron 1 in a plane substantially perpendicular to the axis of said hinges 4 and allowing a relative movement of the elements 2, 3 from a first position to a second position in said plane perpendicular to the axis of the hinge 4.

In another embodiment, an assembly of the elements 2, 3 is disposed along the apron 1 on either side of the apron 1.

Figure 5:
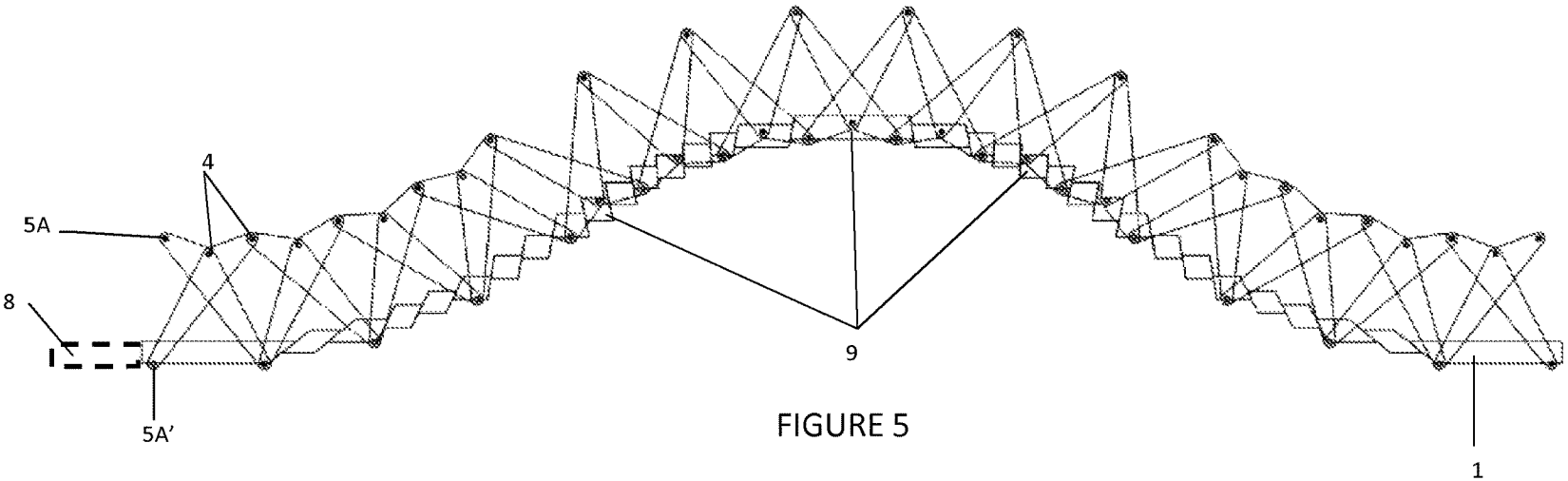
FIG. 5 shows a side view of a work including an assembly of pairs of triangular elongated elements and a deformable apron in the bulged position.

According to the preferred embodiment, drive means 8 are disposed at one of the ends of said work, as illustrated in FIG. 5, to adjust the apron 1 lengthwise, the apron 1 bulging when outwardly drawn.

In a variant, the drive means 8 are disposed at both ends of said work.

The drive means 8 are arranged so that, when the means 8 are actuated, they drive the assembly of the pairs of elements 2, 3, said short portions of the elements 2, 3 being disposed on the upper portion of the pairs of elements 2, 3, disposed at the ends of the work, while said short portions of the pairs of elements 2, 3 are disposed on the lower portion of the pairs of elements 2, 3 disposed towards the center of the work, so as to bulge the central portion of the apron 1. FIG. 5 illustrates a gangway in a raised position, with a bulged central portion, pairs of elements 2, 3 on the central portion being reversed relative to the pairs of elements 2, 3 disposed at each end of the gangway.

In this way, the central portion of the apron 1 rises when outwardly drawn.

The apron 1 consists of a plurality of movable transverse elements 9 disposed alongside each other.

As illustrated in FIGS. 4 and 5, the apron 1 consists of several landings 9. The landings 9 are juxtaposed, with no space between two landings 9, when the apron 1 is in the horizontal position.

In the embodiment illustrated in FIG. 4, the movable transverse elements 9 are juxtaposed when the apron 1 is in the horizontal position.

Figure 6:
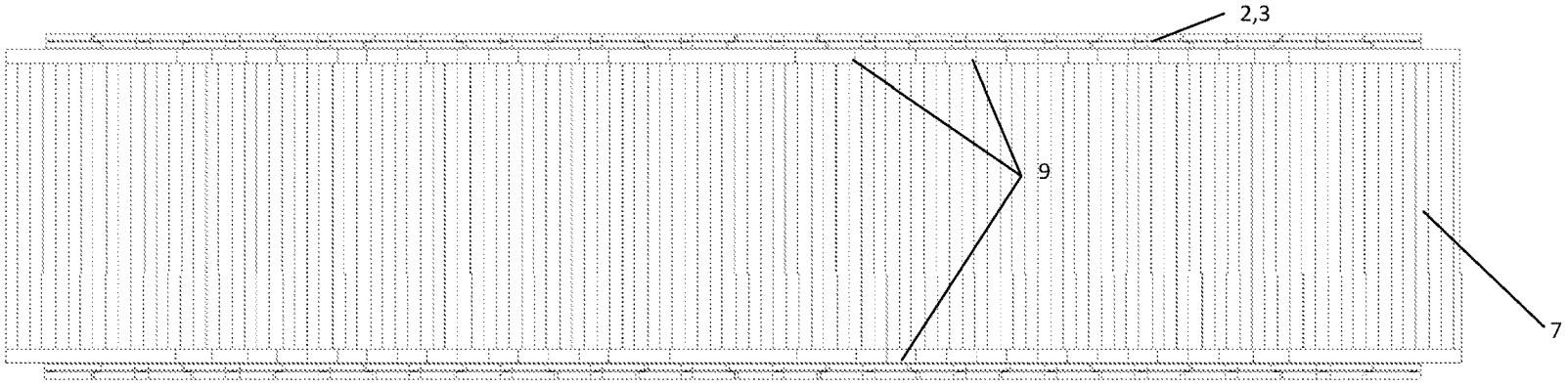
FIG. 6 shows a top view of a work with an apron consisting of wooden joist.

FIG. 6 illustrates a work top view in which the pairs of elements 2, 3 are disposed on either side of the apron 1, said apron 1 consisting of juxtaposed landings 9 and covered with a wooden coating 7.

In a non-illustrated variant, the movable transverse elements 9 are slightly spaced apart relative to each other when the apron 1 is in the horizontal position.

FIG. 5 illustrates movable transverse elements 9 forming the landings articulating relative to each other when the apron 1 is drawn lengthwise, two landings 9 being interlinked for example by a non-illustrated linking arm.

In a non-illustrated variant, the central portion of the apron 1 bulges without creating landings 9. This variant allows obtaining a continuous surface which is practicable for disabled people or vehicles.

In another variant, the apron bulges but a landing per two is tilted, the next one being flat and forming a landing. A half-space landing is required at the top and the bottom of each tilted plane regardless of its length. Different slopes may be arranged, ideally, the slope does not exceed 5%.

According to the preferred embodiment of the invention, the drive means 8, which may be actuated after construction of the work, is an actuator, of the cylinder type, which is arranged at one end of the apron 1. By the way, FIG. 5 illustrates the cylinder on the left portion of the apron 1.

Optionally, the elements 2, 3 constitute the skeleton of the guard-rail and may be adorned so as not to let the structure accessible to all.

The invention claimed is:

1. A movable and dynamic work after construction, linking two points separated by a natural or man-made obstacle, the work allowing the permanent crossing of this obstacle, the work including:

a deformable apron (1) which extends between said two points, a set of elongated elements (2, 3), having three openings (5A, 5A', 5B), a first opening (5A, 5A') at each end of the elements (2, 3) and a second intermediate opening (5B) disposed between the two first openings (5A, 5A') present at the ends of the elements (2, 3), said openings (5, 5A, 5A') receiving ball joints for forming hinges (4), each element (2, 3) consisting of a first short portion between a first opening (5A) and the intermediate opening (5B) and of a second longer portion between the other first opening (5A') and the intermediate opening (5B), the elements (2, 3) being disposed in pairs, movable in rotation, around said central hinge (4) constituted by a ball joint in the intermediate openings (5B) of two elements (2, 3)

an assembly of several pairs of elements (2, 3) made by ball joints inserted into the openings (5A, 5A') disposed at the ends of each element (2, 3), the assembly of said elements (2, 3) being disposed along the apron (1), on one side or on both sides of the apron (1) in a plane substantially perpendicular to the axis of said hinges (4) and allowing a relative movement of the elements (2, 3) from a first position to a second position taking place in said plane perpendicular to the axis of the hinges (4), said short portions of the elements (2, 3) being disposed on the upper portion of the pairs of elements (2, 3) disposed at the ends of the work while said short portions of the elements (2, 3) are disposed on the lower portion of the pairs of elements (2, 3) disposed towards the center of the work, and drive means (8) disposed at one end or at both ends of said work for adjusting the apron (1) lengthwise, said drive means (8) being arranged so that, when the means (8) are actuated, they drive the assembly of the pairs of elements (2, 3), so as to bulge the central portion of the apron (1) when both ends of the work are drawn lengthwise, the drive means may be actuated after construction of the work so as to make it movable and dynamic.

2. The crossing movable and dynamic work according to claim 1, wherein elements (2, 3) have the shape of a scalene triangle of substantially elongated shape, having openings (5A, 5A', 5B) at the tops (6) to receive the ball joints, the intermediate opening (5B) being located towards the top of the triangle with the largest angle.

3. The crossing movable and dynamic work according to any of claim 1, wherein the apron (1) consists of several movable transverse elements (9) disposed next to each other.

4. The crossing movable and dynamic work according to claim 3, wherein the movable transverse elements (9) are juxtaposed when the apron (1) is in the horizontal position.

5. The crossing movable and dynamic work according to claim 3, wherein the movable transverse elements (9) are slightly spaced apart from each other when the apron (1) is in the horizontal position.

6. The crossing movable and dynamic work according to claim 3, wherein the movable transverse elements (9) form landings articulating relative to each other when the apron (1) is drawn lengthwise.

7. The crossing movable and dynamic work according to claim 1, wherein the apron (1) is bulged without creating landings, forming a continuous surface.

8. The crossing movable and dynamic work according to claim 1, wherein the drive means (8) is a cylinder or a hydraulic screw.

9. The crossing movable and dynamic work according to claim 1, wherein the elements (2, 3) constitute the skeleton of a guard-rail, on one side or on both sides of the apron (1).

* * * * *